US006642847B1

(12) United States Patent
Sison

(10) Patent No.: US 6,642,847 B1
(45) Date of Patent: Nov. 4, 2003

(54) POOL ALARM DEVICE

(76) Inventor: Donald R. Sison, 4222 E. Windrose #1010, Phoenix, AZ (US) 85032

( * ) Notice: Subject to any disclaimer, the term of this patent is extended or adjusted under 35 U.S.C. 154(b) by 0 days.

(21) Appl. No.: 09/944,001

(22) Filed: Aug. 31, 2001

(51) Int. Cl.[7] ..... G08B 13/00
(52) U.S. Cl. ..... 340/565; 340/566; 340/573.6
(58) Field of Search ..... 340/565, 566, 340/555, 556, 541, 573.6; 367/118

(56) References Cited

U.S. PATENT DOCUMENTS

| | | | | | |
|---|---|---|---|---|---|
| 4,179,691 | A | | 12/1979 | Keller | |
| 4,187,502 | A | * | 2/1980 | Beverly et al. | 340/566 |
| 4,747,085 | A | * | 5/1988 | Dunegan et al. | 367/93 |
| 4,853,691 | A | * | 8/1989 | Kolbatz | 340/566 |
| 5,023,593 | A | * | 6/1991 | Brox | 340/522 |
| 5,115,222 | A | | 5/1992 | Peralta et al. | |
| 5,268,673 | A | * | 12/1993 | Nelson et al. | 340/566 |
| 5,319,350 | A | | 6/1994 | Demarco et al. | |
| D399,155 | S | | 10/1998 | Roberts | |
| 5,874,898 | A | * | 2/1999 | Peralta et al. | 340/573.6 |
| 5,910,772 | A | | 6/1999 | Hui | |
| 6,130,615 | A | * | 10/2000 | Poteet | 340/573.6 |
| 6,133,838 | A | * | 10/2000 | Meniere | 340/573.6 |
| 6,157,304 | A | * | 12/2000 | Bennett et al. | 340/573.6 |
| 6,278,373 | B1 | * | 8/2001 | Jaurigue et al. | 340/573.6 |

* cited by examiner

*Primary Examiner*—John Tweel

(57) ABSTRACT

A pool alarm device for detecting when a person enters a pool. The pool alarm device includes a detector means for detecting motion. A saddle for holding the detector means removably receives the detector means. A fastening means removably fastens the saddle to the wall of the pool. A transmitter for transmitting a signal is operationally coupled to the detector means. The transmitter transmits a radio signal when the detector means detects motion. A housing holds a control means. A receiver receives a signal transmitted by the transmitter. The receiver is mounted in the housing and is operationally coupled to the control means. A speaker for producing an audible sound is operationally coupled to the control means. The speaker is mounted in the housing. The control means sends an audio signal to the speaker when the receiver receives a transmitted signal.

5 Claims, 4 Drawing Sheets

POOL ALARM DEVICE

BACKGROUND OF THE INVENTION

1. Field of the Invention

The present invention relates to pool alarms and more particularly pertains to a new pool alarm device for detecting when a person enters a pool.

2. Description of the Prior Art

The use of pool alarms is known in the prior art. More specifically, pool alarms heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 5,1125,222; 5,874,898; 5,910,772; 4,179,691; 5,319,350; and Des. 399, 155.

While these devices fulfill their respective, particular objectives and requirements, the aforementioned patents do not disclose a new pool alarm device. The inventive device includes a detector means for detecting motion. A saddle for holding the detector means removably receives the detector means. A fastening means removably fastens the saddle to the wall of the pool. A transmitter for transmitting a signal is operationally coupled to the detector means. The transmitter transmits a radio signal when the detector means detects motion. A housing holds a control means. A receiver receives a signal transmitted by the transmitter. The receiver is mounted in the housing and is operationally coupled to the control means. A speaker for producing an audible sound is operationally coupled to the control means. The speaker is mounted in the housing. The control means sends an audio signal to the speaker when the receiver receives a transmitted signal.

In these respects, the pool alarm device according to the present invention substantially departs from the conventional concepts and designs of the prior art, and in so doing provides an apparatus primarily developed for the purpose of detecting when a person enters a pool.

SUMMARY OF THE INVENTION

In view of the foregoing disadvantages inherent in the known types of pool alarms now present in the prior art, the present invention provides a new pool alarm device construction wherein the same can be utilized for detecting when a person enters a pool.

The general purpose of the present invention, which will be described subsequently in greater detail, is to provide a new pool alarm device apparatus and method which has many of the advantages of the pool alarms mentioned heretofore and many novel features that result in a new pool alarm device which is not anticipated, rendered obvious, suggested, or even implied by any of the prior art pool alarms, either alone or in any combination thereof.

To attain this, the present invention generally comprises a detector means for detecting motion. A saddle for holding the detector means removably receives the detector means. A fastening means removably fastens the saddle to the wall of the pool. A transmitter for transmitting a signal is operationally coupled to the detector means. The transmitter transmits a radio signal when the detector means detects motion. A housing holds a control means. A receiver receives a signal transmitted by the transmitter. The receiver is mounted in the housing and is operationally coupled to the control means. A speaker for producing an audible sound is operationally coupled to the control means. The speaker is mounted in the housing. The control means sends an audio signal to the speaker when the receiver receives a transmitted signal.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new pool alarm device apparatus and method which has many of the advantages of the pool alarms mentioned heretofore and many novel features that result in a new pool alarm device which is not anticipated, rendered obvious, suggested, or even implied by any of the prior art pool alarms, either alone or in any combination thereof.

It is another object of the present invention to provide a new pool alarm device which may be easily and efficiently manufactured and marketed.

It is a further object of the present invention to provide a new pool alarm device which is of a durable and reliable construction.

An even further object of the present invention is to provide a new pool alarm device which is susceptible of a low cost of manufacture with regard to both materials and labor, and which accordingly is then susceptible of low prices of sale to the consuming public, thereby making such pool alarm device economically available to the buying public.

Still yet another object of the present invention is to provide a new pool alarm device which provides in the apparatuses and methods of the prior art some of the advantages thereof, while simultaneously overcoming some of the disadvantages normally associated therewith.

Still another object of the present invention is to provide a new pool alarm device for detecting when a person enters a pool.

Yet another object of the present invention is to provide a new pool alarm device which includes a detector means for detecting motion. A saddle for holding the detector means removably receives the detector means. A fastening means removably fastens the saddle to the wall of the pool. A transmitter for transmitting a signal is operationally coupled to the detector means. The transmitter transmits a radio signal when the detector means detects motion. A housing holds a control means. A receiver receives a signal transmitted by the transmitter. The receiver is mounted in the housing and is operationally coupled to the control means. A speaker for producing an audible sound is operationally coupled to the control means. The speaker is mounted in the housing. The control means sends an audio signal to the speaker when the receiver receives a transmitted signal.

Still yet another object of the present invention is to provide a new pool alarm device that sends a signal to a receiver which may be moved about a dwelling such that it is easily heard.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
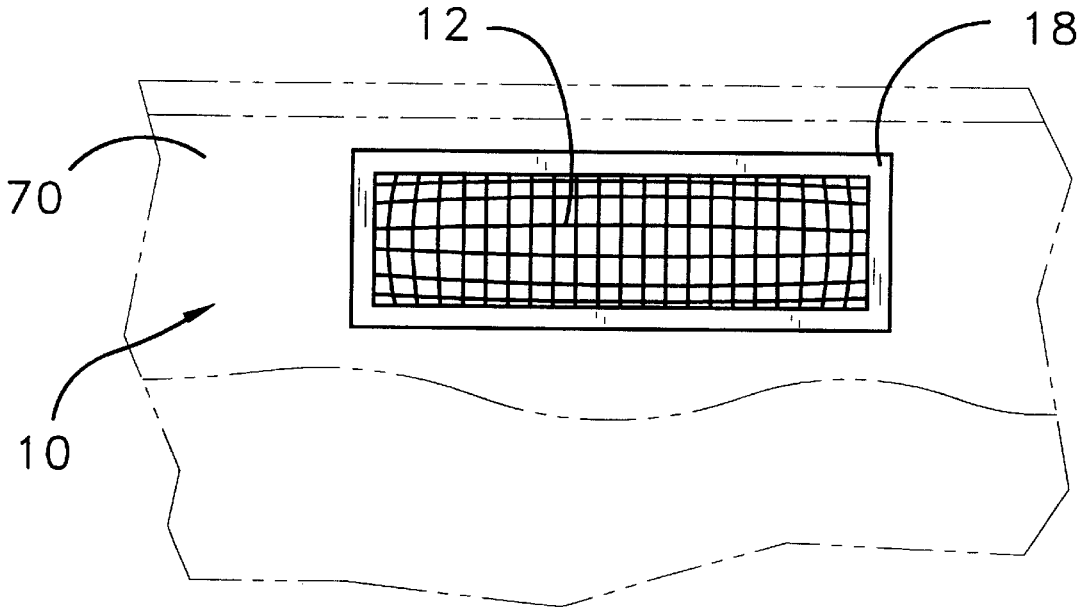
FIG. 1 is a schematic front view of a new pool alarm device according to the present invention.
Figure 2:
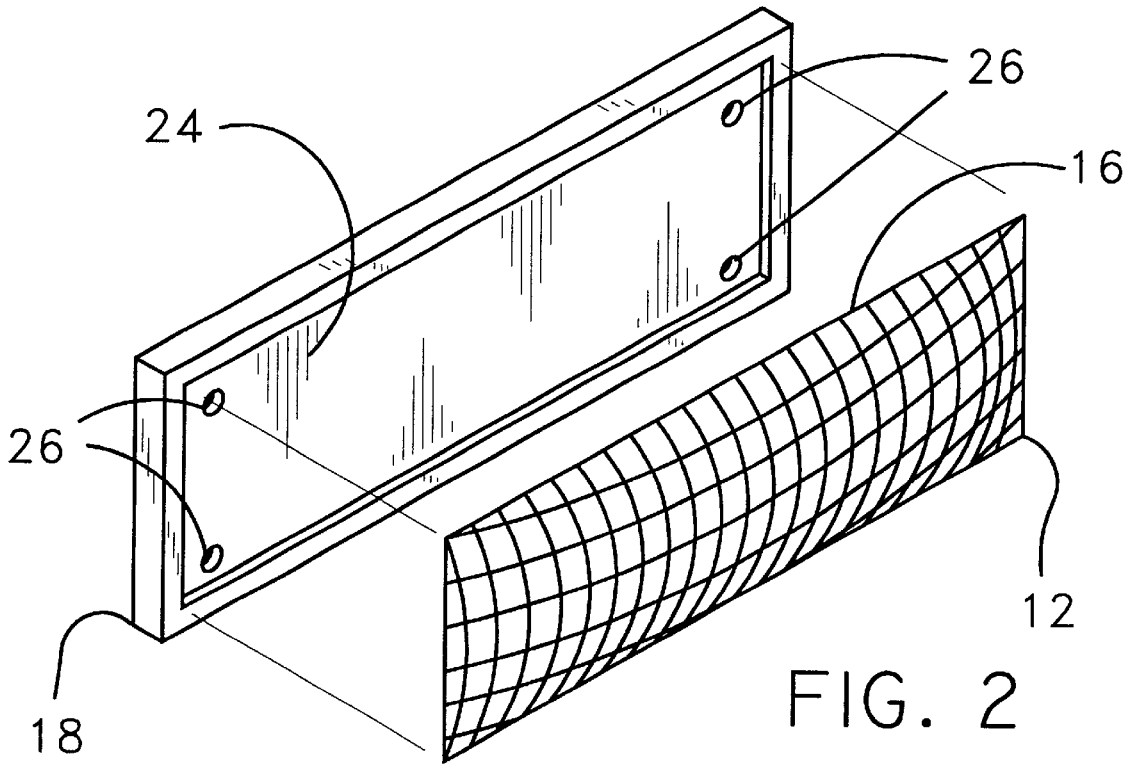
FIG. 2 is a schematic perspective view of the present invention.
Figure 4:
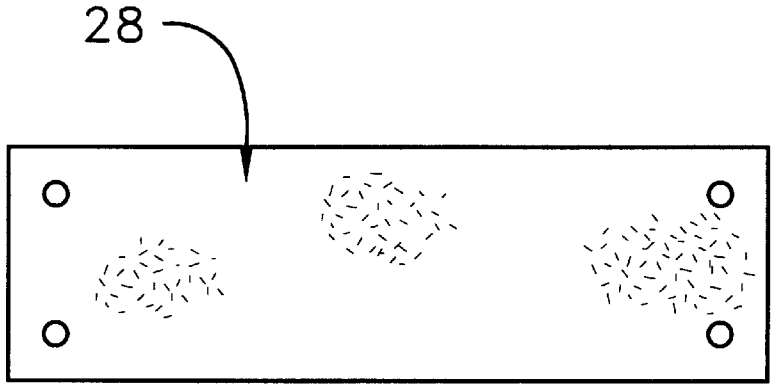
FIG. 4 is a schematic back view of the present invention.
Figure 3:
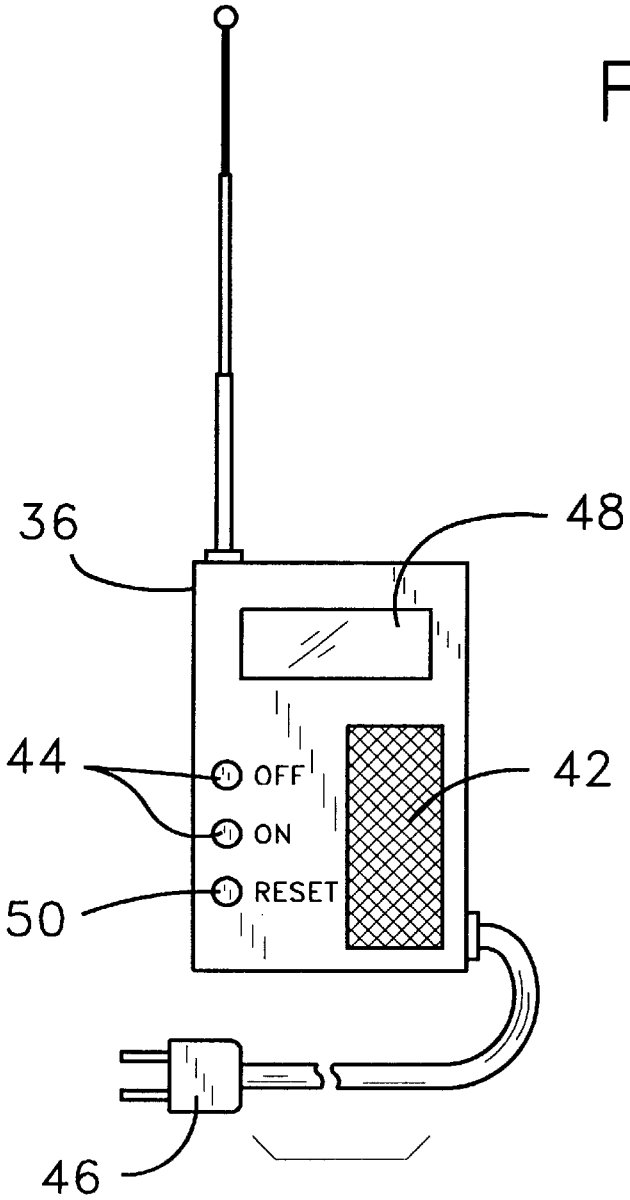
FIG. 3 is a schematic front view of a receiver housing of the present invention.
Figure 5:
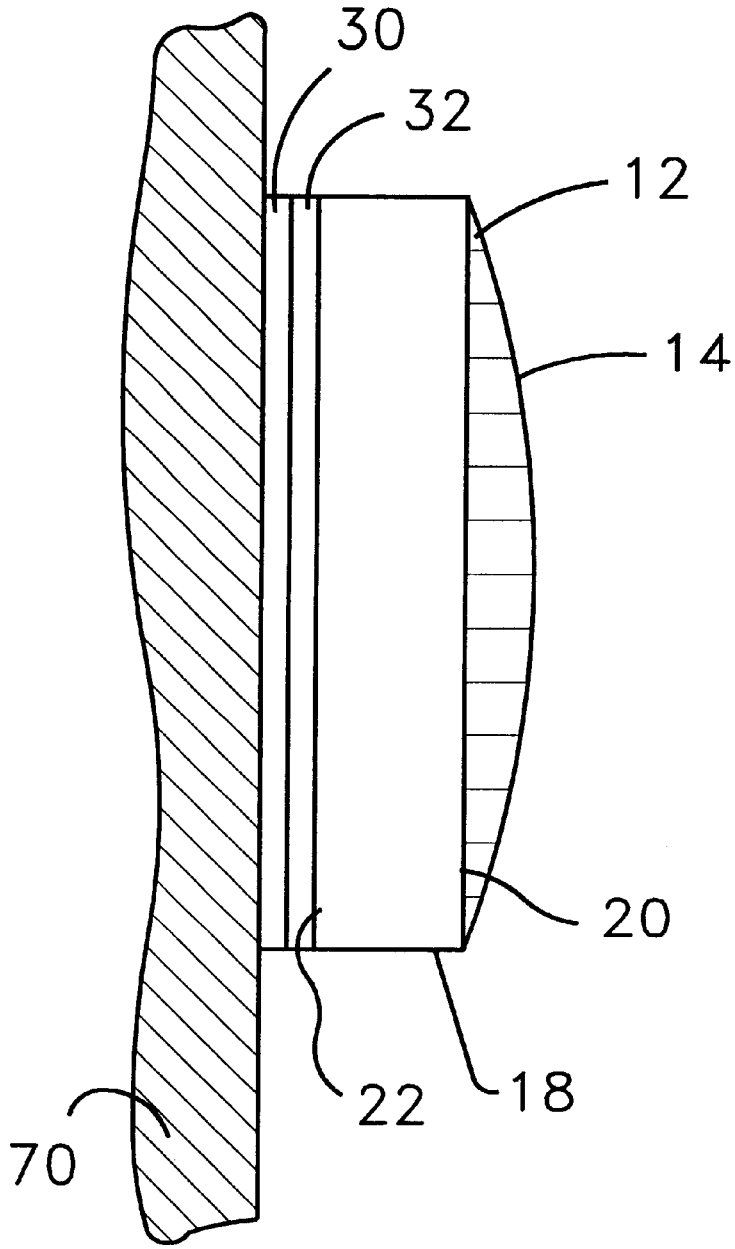
FIG. 5 is a schematic side view of the present invention.
Figure 6:
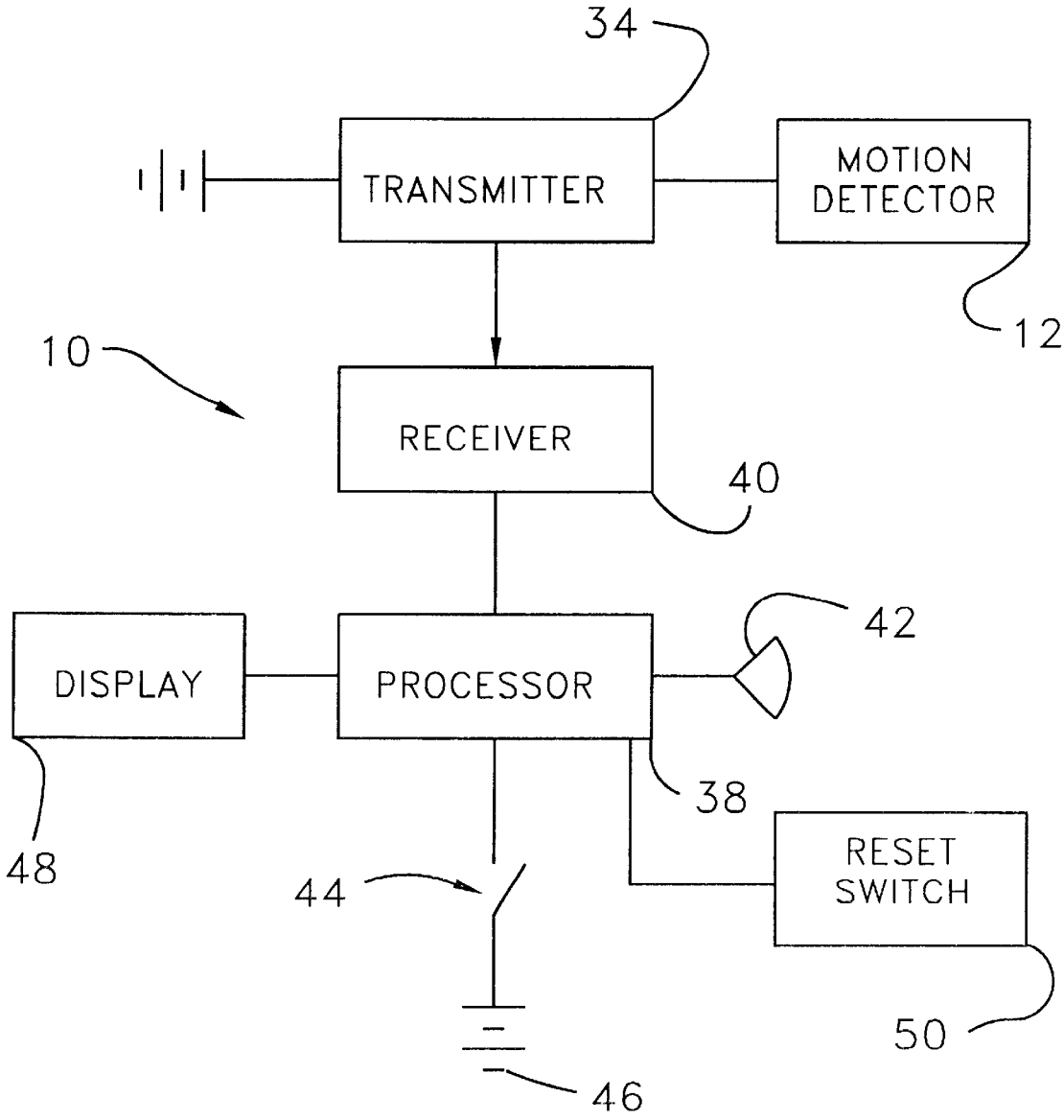
FIG. 6 is a schematic view of the present invention.

With reference now to the drawings, and in particular to FIGS. 1 through 6 thereof, a new pool alarm device embodying the principles and concepts of the present invention and generally designated by the reference numeral 10 will be described.

As best illustrated in FIGS. 1 through 6, the pool alarm device 10 generally comprises a detector means 12 for detecting motion. The detector means 12 comprises an infrared motion sensor. The detector has a front side 14 and a back side 16. The back side 16 has a generally rectangular shape.

A saddle 18 holds the detector means to a wall 70 of a pool. The saddle 18 comprises a panel having a first surface 20 and a second surface 22. The first surface 20 has a depression 24 therein having a size and shape substantially equal to the back side 16 of the detector means 12. The back side 16 is positionable in the depression 24 such that the detector means 12 is removably mounted in the saddle 18. The panel, or saddle 18, may have a plurality of apertures 26 extending therethrough for receiving a plurality of mechanical securing members, such as bolts, for attaching the detector 12 to the saddle 18 or the saddle 18 to the wall 70 of the pool.

A fastening means 28 removably fastens the saddle 18 to the wall 70 of the pool. The fastening means 28 comprises a hook and loop fastening means having a hook portion 30 attached to the wall 70 and a loop portion 32 attached to the second surface 22 of the saddle 18. This allows easy detachment from the wall 70 of the pool such as during cold weather months.

A transmitter 34 transmits a signal is operationally coupled to the detector means 12. The transmitter 34 transmits a radio signal when the detector means 12 detects motion. The transmitter is ideally incorporated within a body holding the transmitter 34 and the detector means 12.

A housing 36 holds a control means 38, or processor. A receiver 40 for receiving a signal transmitted by the transmitter 34 is mounted in the housing 36 and operationally coupled to the control means 38. A speaker 42 for producing an audible sound is operationally coupled to the control means 38. The speaker 42 is mounted in the housing 36. The control means 38 sends an audio signal to the speaker 42 when the receiver 40 receives a transmitted signal. An actuator 44 for selectively turning the control means 38 on or off is operationally coupled to the control means 38. The actuator 44 is mounted on the housing. A power supply 46 is operationally coupled to the actuator 44. A low power indicator 48 is positioned on the housing 36 and is operationally coupled to the control means 38. The low power indicator 48 is preferably a liquid crystal display. Preferably, a reset switch 50 for resetting the control means after receiving a transmitted signal is operationally coupled to the control means 38 and positioned on the housing 36.

In use, a plurality of detector means 12 is positioned around the periphery of a pool. In the event a person falls into the pool, the transmitters 34 send a signal to the receiver 40 which in turn causes an audible alarm to sound via the speaker 42. This alerts a parent or guardian of the possible danger of drowning.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An alarm system for objects falling into a pool comprising:

a detector means for detecting motion;

a saddle for holding said detector means, said detector means is removably mounted in said saddle;

a fastening means for removably fastening said saddle to the wall of the pool;

a transmitter for transmitting a signal being operationally coupled to said detector means, wherein said transmitter transmits a radio signal when said detector means detects motion;

a housing;

a control means being positioned in said housing;

a receiver for receiving a signal transmitted by said transmitter being mounted in said housing, said receiver being operationally coupled to said control means;

a speaker for producing an audible sound being operationally coupled to said control means, said speaker being mounted in said housing, wherein said control means sends an audio signal to said speaker when said receiver receives a transmitted signal; and wherein said detector has a front side and a back side, said back side having a generally rectangular shape, said saddle comprising a panel having a first surface and a second surface, said first surface having a depression therein, said depression having a size and shape substantially equal to said back side of said detector means, wherein said back side is positionable in said depression.

2. The alarm system as in claim 1, wherein said detector means comprises an infrared motion sensor.

3. The alarm system as in claim 1, wherein said fastening means comprises a hook and loop fastening means having a hook portion attached to the wall and a loop portion attached to said second surface of said saddle.

4. The alarm system as in claim 1, further including an actuator for selectively turning said control means on or off being operationally coupled to said control means, said actuator being mounted on said housing.

5. An alarm system for objects falling into a pool comprising:

a detector means for detecting motion, said detector means comprising an infrared motion sensor, said detector having a front side and a back side, said back side having a generally rectangular shape;

a saddle for holding said detector means, said saddle comprising a panel having a first surface and a second surface, said first surface having a depression therein, said depression having a size and shape substantially equal to said back side of said detector means, wherein said back side is positionable in said depression such that said detector means is removably mounted in said saddle;

a fastening means for removably fastening said saddle to the wall of the pool, said fastening means comprising a hook and loop fastening means having a hook portion attached to the wall and a loop portion attached to said second surface of said saddle;

a transmitter for transmitting a signal being operationally coupled to said detector means, wherein said transmitter transmits a radio signal when said detector means detects motion;

a housing;

a control means being positioned in said housing;

a receiver for receiving a signal transmitted by said transmitter being mounted in said housing, said receiver being operationally coupled to said control means;

a speaker for producing an audible sound being operationally coupled to said control means, said speaker being mounted in said housing, wherein said control means sends an audio signal to said speaker when said receiver receives a transmitted signal;

an actuator for selectively turning said control means on or off being operationally coupled to said control means, said actuator being mounted on said housing;

a power supply being operationally coupled to said actuator; and a low power indicator being positioned on said housing and being operationally coupled to said control means.

* * * * *